United States Patent [19]

Ehrmann et al.

[11] 4,111,168

[45] Sep. 5, 1978

[54] IGNITION DISTRIBUTOR-CIRCUIT BREAKER ASSEMBLY FOR INTERNAL COMBUSTION ENGINES

[75] Inventors: Karl Ehrmann; Richard Gerber, both of Stuttgart; Klaus Doderer, Neuenburg, all of Fed. Rep. of Germany

[73] Assignee: Robert Bosch GmbH, Stuttgart, Fed. Rep. of Germany

[21] Appl. No.: 669,836

[22] Filed: Mar. 24, 1976

[30] Foreign Application Priority Data

May 28, 1975 [DE] Fed. Rep. of Germany ..... 2523638

[51] Int. Cl.[2] ..... F02P 5/00

[52] U.S. Cl. ..... 123/117 A; 123/117 R; 74/424.8 R

[58] Field of Search ..... 123/117 A, 117 R

[56] References Cited

U.S. PATENT DOCUMENTS

| | | | |
|---|---|---|---|
| 2,162,243 | 6/1939 | Browne | 123/117 A |
| 2,184,789 | 12/1939 | Arthur | 123/117 A |
| 2,390,619 | 12/1945 | Setterblade | 123/117 A |
| 2,394,792 | 2/1946 | MacMillan | 123/117 A |
| 2,871,840 | 2/1959 | DeClaire | 123/117 A |
| 3,301,242 | 1/1967 | Candelise | 123/117 A |
| 3,457,905 | 7/1969 | Jukes | 123/117 A |
| 3,791,357 | 2/1974 | Cook | 123/117 R |
| 3,813,877 | 6/1974 | Hunt | 123/117 A |
| 3,817,234 | 6/1974 | Jirousek | 123/117 R |

FOREIGN PATENT DOCUMENTS

| | | | |
|---|---|---|---|
| 176,550 | 4/1917 | Canada | 123/117 R |
| 2,301,711 | 7/1973 | Fed. Rep. of Germany | 123/117 A |
| 199,874 | 9/1938 | Switzerland | 123/117 A |
| 209,585 | 4/1940 | Switzerland | 123/117 A |
| 514,670 | 11/1939 | United Kingdom | 123/117 A |
| 970,904 | 9/1964 | United Kingdom | 123/117 A |

*Primary Examiner*—Charles J. Myhre
*Assistant Examiner*—Jeffrey L. Yates
*Attorney, Agent, or Firm*—Flynn & Frishauf

[57] ABSTRACT

To provide for fine adjustment of the timing of operation of the ignition breaker switches, the breaker plate is connected by an adjustable link to a vacuum ignition control diaphragm, the link being a two-element unit, one element having a right-hand thread at the end and the other a left-hand thread, coupled by a coupling element rotatable in both said right and left-hand threads to shorten or lengthen the overall length of the link. The coupling element is externally accessible, for example by means of an additional transmission wheel or gear.

8 Claims, 5 Drawing Figures

IGNITION DISTRIBUTOR-CIRCUIT BREAKER ASSEMBLY FOR INTERNAL COMBUSTION ENGINES

CROSS REFERENCE TO RELATED APPLICATION

U.S. Ser. No. 666,587 filed Mar. 15, 1976, Heine, now U.S. Pat. No. 4,040,407 claiming priority of German assigned to the assignee of the present application.

The present invention relates to an ignition breaker unit for internal combustion engines, usually combined with an ignition distributor, in which a breaker contact support plate is located on a breaker plate within a housing, the shaft of the distributor operating the breaker contacts, and in which a vacuum diaphragm controls the timing adjustment of the breaker operation.

Ignition breaker units — usually combined with distributors and hence, for convenience, herein referred to as "distributors" — are usually secured to or inserted in the motor block of the internal combustion engine with which they are to cooperate. The distributor shaft is driven directly, or by means of intermediate positive drive elements, with the cam shaft, the control shaft, or the main shaft of the engine. The position of the ignition breaker contacts with respect to the housing of the distributor, and hence with respect to the motor block and to a specific angular position of the ignition shaft and the breaker cam thereon, is determined by means of markings on the motor block. Thus, the distributor can be accurately placed with respect to the motor block. In one form, the attachment element is a claw clamped to the motor block by means of a bolt, the claw being formed to engage an extension formed on the housing of the distributor to clamp the distributor housing to the motor block in predetermined position. Fine adjustment of ignition timing can be accomplished by adjusting fine-setting arrangements from outside of the housing.

Various arrangements have been proposed to change the fine adjustment of the ignition timing, in which the entire distributor or parts thereof are changed with respect to the motor. These arrangements have been abandoned for a long time for other adjustment systems.

It is an object of the present invention to provide an adjustment arrangement for the ignition timing of breaker contact operation of distributors which is simple, permits accurate adjustment of the ignition instant when the motor is running and which reliably maintains the timing adjustment in spite of vibration of the motor, shocks transmitted to the distributor upon operation of the motor if applied to an automotive vehicle, and the like.

SUBJECT MATTER OF THE PRESENT INVENTION

Briefly, a connecting link is pivoted to the breaker support plate, the connecting link having two end elements which are connected by a coupling. The end elements have, respectively, at facing ends right and left-hand threads, the coupling member being a sleeve likewise tapped with right and left-hand threads at opposite ends, the sleeve being engageable by a rotation-transmitting element which is externally accessible.

In essence, the invention uses the principle of a turn buckle in combination with an adjustment link, the turn buckle adjusting the effective length of the link in simple and effective manner.

In accordance with a preferred feature of the invention, a resilient, springy element engages the sleeve which, preferably, is toothed or knurled, the resilient element preventing rotation of the sleeve unless commanded by the manually engageable, externally accessible rotation-transmitting member.

The invention will be described by way of example with reference to the accompanying drawings, wherein.

Figure 1:
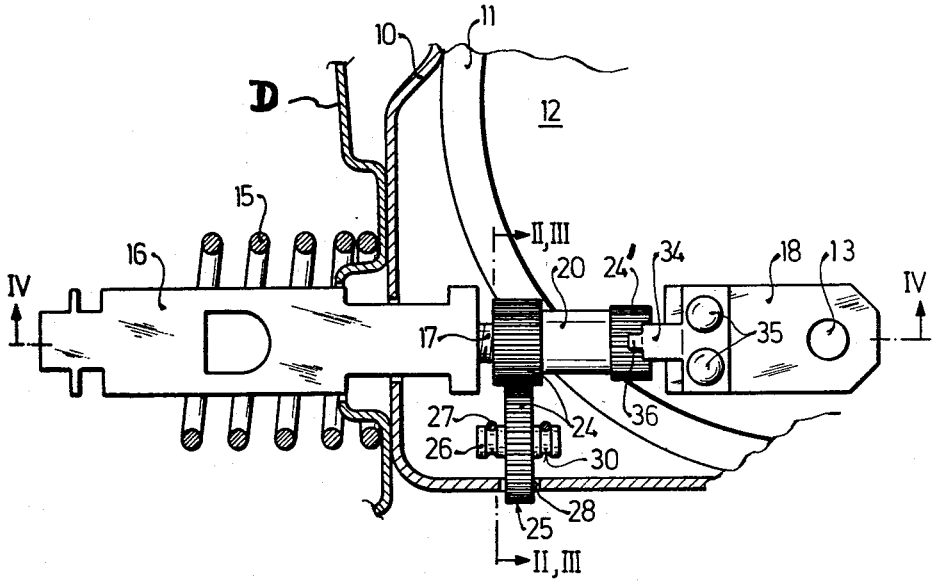
FIG. 1 is a fragmentary horizontal sectional view through that portion of a distributor — breaker assembly which provides for adjustment of the breaker support plate.
Figure 4:
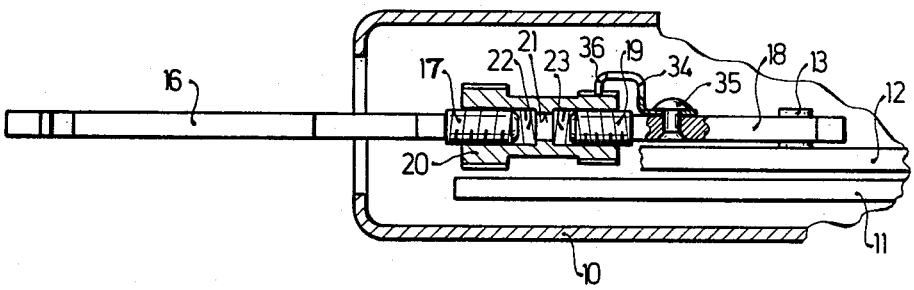
FIG. 4 is a side view, partly in section, along lines IV—IV of FIG. 1.

The housing 10 (FIGS. 1, 4) of the distributor is provided with a carrier plate 11 on which a breaker support plate 12 is movably located. The breaker support plate 12 has a pin 13 thereon on which a link element 18 is pivoted. A vacuum ignition advance-retard diaphragm D, of which only a fragmentary housing portion is shown, is connected to the housing 10 of the distributor. The diaphragm D has a membrane which is supported by a spring 15 from its housing D, and hence from the housing 10. The operating element connected to the movable membrane of the diaphragm is a link element 16 usually, as shown, a flat piece of strip steel. It terminates in a bolt 17 having a right-hand thread formed thereon. The link element 18, pivoted to pin 13, is also a flat piece of strip steel; it terminates in a threaded bolt 19 (FIG. 4) having a left-hand thread formed thereon.

A sleeve 20 is formed with a through-bore in which, at the respective ends, right and left-hand threads 22, 23 are formed. Each one of the threads cooperates with the respective bolts 18, 19. The outer circumference of sleeve 20 has a gear portion or toothed portion 24 formed thereon which gear or toothed portion 24 may extend over only a part of the circumference of the sleeve 20 (see FIG. 2). An adjustment member 25, formed as a thumb-wheel, also has gear teeth 24 formed thereon, matching the teeth 24 of sleeve 20. The thumb-wheel 25 is secured to a shaft 26 which is journalled by two spring clips 27, 27 in the housing, the spring clips being located at either side of the thumb-wheel 25. The thumb-wheel 25 is located so as to be externally accessible from housing 10; housing 10, to this end, is formed with a slit 28. The two spring clips 27 engage in semicircular grooves 30 formed at opposite sides of thumb-wheel 25 in the shaft 26, so that the thumb-wheel 25 is rotatably located and axially positioned. Both spring clips 27 are made of spring wire and are so bent that the center portion thereof forms a bent loop engaging around groove 30 on shaft 26. The ends 31 of the clips 27 are located in holes 32 formed in the housing 10.

Figure 2:
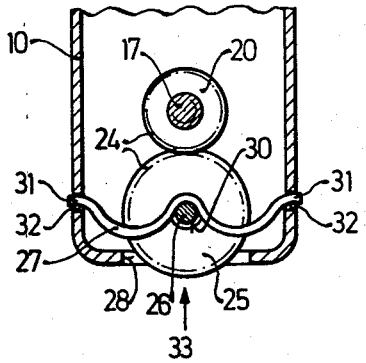
FIG. 2 is a sectional view along lines II—II of FIG. 1, illustrating the adjustment device in engaged condition.
Figure 3:
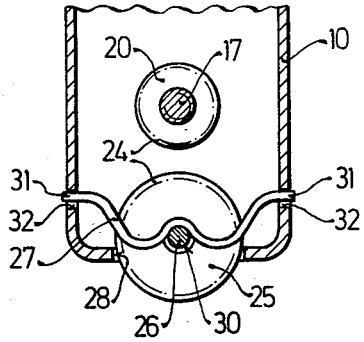
FIG. 3 is a similar view to that of FIG. 2, illustrating the adjustment device in rest condition.

Operation, with reference to FIGS. 1–4: FIG. 3 illustrates the sleeve 20 and the thumb-wheel 25 in quiescent condition. The two spring clips 27, secured with their ends 31 in holes 32, press the thumb-wheel 25 into the slit 28 formed in the housing 10, so that the thumb-wheel 25 essentially completely closes off the housing 10, and prevents dirt, dust, or other contaminants from entering the housing and hence possibly affecting adjustment of the distributor plate 12. If it is desired to adjust the timing, then thumb-wheel 25 is pressed inwardly against the tension of the spring clips 27 to the position of FIG. 2. This is schematically illustrated by force arrow 33; so long as force 33 acts on thumb-wheel 25, the gear teeth 24 on the thumb-wheel 25 and on sleeve 20 will engage, so that thereby a rotation-transmissive connection will result. In this engaged position of thumb-wheel 25, rotation of the thumb-wheel 25 will cause rotation of the sleeve 20 and hence lengthening or shortening of the effective length of the overall linkage formed by the plates 16, 18 and the attached bolts 17, 19 and coupling sleeve 20. Thus, the two end plates 16, 18 are pulled towards each other or pressed away from each other, thereby changing the effective length of the linkage. The end plate 16 is held in fixed position by the membrane of the diaphragm; thus, any adjustment of the effective length of the linkage will affect the position of link 18 and hence of pivot 13 on breaker plate 12 and rotate the breaker plate 12 over its central pivot point (not shown), thereby effecting fine adjustment of ignition timing.

Internal combustion engines, and their associated components, particularly when applied in automotive use, are subject to vibration, shock and other outside disturbances which affect their relative adjustment. To prevent undesired, unintended rotation of sleeve 20, an engaging element 34 (FIG. 4) is secured to link 18. This element 34 is a strip of spring steel, one end of which is held by two rivets 35 (FIGS. 1, 4) on the link 18. It is bent over to form a resilient end portion or tongue 35 which has a sharp edge, in the nature of a knife edge, resiliently engaging in gearing 24' (FIGS. 1, 4) of the sleeve 20. The spring 34 thus secures sleeve 20 with respect to undesired, unintended rotation in the position in which it is placed when rotating thumb-wheel 25, when pressed in as seen in FIG. 2. If adjustment is necessary, the rotating sleeve 20 can still turn against the resilient tongue 36, by lifting tongue 36 out of engagement with the groove between lands of the teeth of the gearing 24', the resiliency of element 34 permitting the tongue to jump from one gear tooth to the next until the new adjusted position is reached, at which point the element 34 will lock sleeve 20 in position.

Figure 5:
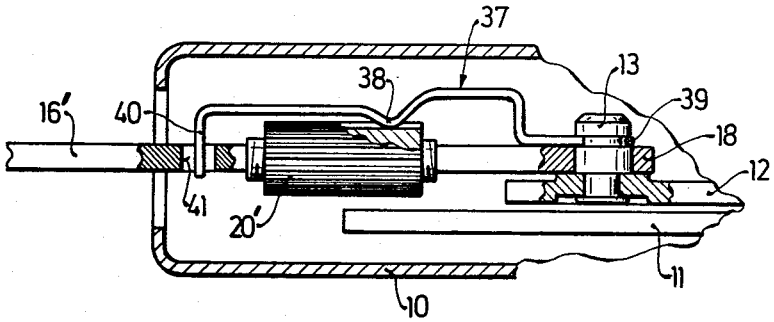
FIG. 5 is a sectional view similar to FIG. 4 but illustrating another embodiment to prevent spurious rotation of the adjustment sleeve.

FIG. 5 illustrates another embodiment of the position maintenance feature in accordance with the present invention, and in which elements similar to those previously described have been given the same reference numerals and will not be described again. A spring 37, for example of spring steel wire, is formed with a V-shaped notch, the projecting bulge of which engages in the serrations of sleeve 20'. Sleeve 20' is preferably continuously grooved, toothed or knurled. The engagement wheel 25 has been omitted from FIG. 5 (as it has from FIG. 4), for clarity of illustration. Spring 37 extends beyond and reaches around sleeve 20' and is bent over in a hook 40 which fits into an elongated hole 41 formed in link 16'. The other end of spring 37 is bent into eyelet form and secured to pin 13', pivoted to breaker plate 12. The complementary projection to the notch 38 secures sleeve 20' against undesired, spurious rotation; simultaneously, the hook 40 engaging the elongated hole 41 in link 16 limits the extent of longitudinal adjustment of the overall length of the linkage and additionally prevents removal of the sleeve 20 from the one, or the other, or both of the threaded ends 17, 19.

Adjustment of the ignition timing instant is reliable and can be effected without introducing play or tolerances in the adjusting movement. There is no undesirable hysteresis of adjustment, that is, rotation of the sleeve 20 in either direction will effect length adjustment without dead movement. The adjustment element formed by thumb-wheel 25 is axially fixed in the housing; it is radially movable, however, to either engage or disengage with the respective gearing 24 of sleeve 20, or 20'. Upon rotation of sleeve 20, or 20', respectively, the effective length of the connection between link 16 and pivot point 13 are changed by moving both threaded bolt elements 17, 19 into and out of the sleeve simultaneously. The slit 28 formed in the housing is so dimensioned that thumb-wheel 25, when in the position shown in FIG. 3, that is, in its rest or inoperative position, closes or almost closes the slit, under tension of the resilient spring clips 27. Disengagement of the thumb-wheel 25 from sleeve 20, 20', when no adjustment is intended, provides for unambiguous setting of the sleeve 20 and unambiguous location of the thumb-wheel 25, the two elements being out-of-engagement so that no spurious transmission of rotation between the elements can occur. The spring clips 27, engaging in grooves 30 of the shaft 26 of the thumb-wheel 25, are inexpensive to manufacture and to assemble; the entire arrangement is simple to make, while effective in use, and lends itself readily to high-rate mass production.

Internal combustion engines used in automotive vehicles must have the adjustment reliably maintained even the most unfavorable operating conditions. It is particularly important to ensure positioning of any adjustment element in such a way that undesired, unintended rotation is prevented. The resilient locks illustrated and discussed in connection with FIGS. 4 and 5, namely springs 34, 37, respectively, provide for maintenance of the position of the sleeve 20 with respect to the threads on bolts 17, 19 even under the worst conditions. The springs 34, 37 engage between the grooves of the teeth, or gear elements formed on the outside of the sleeve. The arrangement illustrated in connection with FIG. 5 is particularly simple to manufacture and assemble, and is a suitable arrangement for high-rate mass production. The additional provision of hook 40 engaging in the elongated hole 41 of link 16' ensures that adjustment, even if carried out by unskilled or careless personnel will not disable the distributor assembly since the extent of rotation of the sleeve 20' is limited so that the threaded shaft ends 17, 19 cannot escape therefrom.

The structure can be made inexpensively in mass production, by using screw machinery and the like, and provides for effective fine adjustment of ignition timing. The arrangement can be added to existing distributors, or existing distributor designs can readily be modified by incorporating therein the adjustment arrangement without substantial change to the housing structure, or the overall arrangement of most commercial distributors.

Various changes and modifications may be made, and features described in connection with any one of the embodiments may be used with any of the others, within the inventive concept.

I claim:

1. Ignition distributor and circuit breaker assembly for internal combustion engines having a housing (10);

a slit (28) formed in the housing;

a breaker support plate (12) mounted in the housing for limited rotation therein to support a breaker assembly;

and means (15) controlling the position of the support plate (12) in the housing including a link means (16,

17, 18, 19, 20) the length of which is adjustable, connecting said position control means (15) to the plate (12), wherein said link means comprises a first end element (16, 17) having a left-hand thread, and a second end element (18, 19) having a right-hand thread, and a rotatable coupling sleeve (20, 20') having left hand threads and right-hand threads at opposite end portions in threaded engagement with the respective end elements and formed, externally, with cylindrical shape and a serrated or gear-shaped outer surface a rotation-transmitting disk-shaped element (25) penetrating in part through said slit (28) in the housing and accessible externally from said housing said disk being formed with a serrated, gear-shaped circumference and located for coupling engagement with respect to said rotatable sleeve (20) to permit rotation of said sleeve and thereby adjust the effective length of said link means and hence the position of said plate (12) in the housing with respect to said position control means (15);

a central shaft (26) extending from both sides of said disk-shaped element;

a pair of spring clips located in said housing, shaped to engage at least in part around said central shaft (26), the spring clips securing said disk shaped element member in axially fixed, but laterally movable position within said housing;

said slit being of lesser size than the diameter of the disk-shaped element, the spring clips locating said rotation transmitting member in position out of engagement with the sleeve and closing off said slit (28) but permitting inward movement of said disk shaped element and engagement with the serrated or gear-shaped circumference of said sleeve.

2. Assembly according to claim 1, wherein the spring clips comprise a pair of spring wire elements secured in said housing, said wire elements being formed with reentrant bends, and the shaft (26) of the rotation-transmitting member is formed with grooves fitting into said reentrant bend.

3. Assembly according to claim 1, further comprising spring means (34, 37) secured to said link means and resiliently engaging the outer circumference of said sleeve to prevent spurious rotation thereof.

4. Assembly according to claim 1 further comprising wherein means positively positioning said sleeve comprising spring means located in said housing and shaped to engage in the grooves between the lands formed by the serrated or gear-shaped outer circumference of said sleeve.

5. Assembly according to claim 4, wherein said spring means comprises a snap spring (34) terminating in a knife edge, the knife edge fitting in the grooves between the lands formed by the serrated or gear-shaped outer circumference of said sleeve.

6. Assembly according to claim 4, wherein said spring means comprises a spring wire element (37) secured within the housing and formed with a V-shaped projection, located to engage the grooves between the lands formed by the in serrated or gear-shaped surface of said sleeve (20').

7. Assembly according to claim 6, wherein said link means is formed with an elongated opening (41) and said wire spring includes a hook-shaped portion (40) engaging in the elongated opening to limit movement of said link means upon rotation of said sleeve.

8. Assembly according to claim 1, further comprising cooperating means (40, 41) respectively formed on said link means and secured to said housing and limiting extension of said link means upon rotation of the sleeve.

* * * * *